US008097838B2

(12) United States Patent
Rönn et al.

(10) Patent No.: US 8,097,838 B2
(45) Date of Patent: Jan. 17, 2012

(54) METHOD OF INCREASING THE RANGE OF A SUBCALIBRE SHELL AND SUBCALIBRE SHELLS WITH A LONG RANGE

(75) Inventors: Torsten Rönn, Karlskoga (SE); Thomas Pettersson, Karlskoga (SE); Ulf Heiche, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 737 days.

(21) Appl. No.: 12/093,220

(22) PCT Filed: Sep. 14, 2006

(86) PCT No.: PCT/SE2006/001047

§ 371 (c)(1),
(2), (4) Date: Nov. 10, 2008

(87) PCT Pub. No.: WO2007/058573

PCT Pub. Date: May 24, 2007

(65) Prior Publication Data

US 2009/0090809 A1 Apr. 9, 2009

(30) Foreign Application Priority Data

Nov. 15, 2005 (SE) ..... 0502509

(51) Int. Cl.
*F42B 15/01* (2006.01)

(52) U.S. Cl. ..... 244/3.27; 244/3.24; 102/490

(58) Field of Classification Search ..... 244/3.27, 244/3.24, 3.28, 3.29; 102/490, 473, 501
See application file for complete search history.

(56) References Cited

U.S. PATENT DOCUMENTS

| | | | | |
|---|---|---|---|---|
| 4,336,914 | A * | 6/1982 | Thomson | 244/46 |
| 4,826,105 | A * | 5/1989 | Smiley | 244/49 |
| 5,439,188 | A | 8/1995 | Depew, Jr. et al. | |
| 5,780,766 | A * | 7/1998 | Schroppel | 102/372 |
| 6,748,871 | B2 * | 6/2004 | Hellman | 102/490 |
| 6,764,042 | B2 * | 7/2004 | Moore et al. | 244/3.28 |
| 6,769,643 | B2 * | 8/2004 | Bar et al. | 244/3.28 |
| 6,796,525 | B2 * | 9/2004 | Johnsson et al. | 244/3.28 |
| 6,869,044 | B2 * | 3/2005 | Geswender et al. | 244/3.29 |
| 6,880,780 | B1 * | 4/2005 | Perry et al. | 244/3.27 |

(Continued)

FOREIGN PATENT DOCUMENTS

EP 1321737 A2 * 6/2003

(Continued)

*Primary Examiner* — Christopher P Ellis
(74) *Attorney, Agent, or Firm* — Connolly Bowe Lodge & Hutz LLP

(57) ABSTRACT

The invention relates to a method for increasing the range of shells (1, 8, 13) charged with an explosive substance and other types of shell, which function as carriers of the one or other type of active payload. The method according to the invention thus provides an opportunity for increasing the range of fire of most types of artillery piece by increasing the muzzle velocity and the gliding flight capability of shells or projectiles fired from them, but without the need to increase the energy content in the propellant charges utilized for firing the shells or the projectiles concerned. The novelty proposed in accordance with the invention instead represents a radical modification to the design of the shell (1, 8, 13) utilized in conjunction therewith. The invention also relates to a shell charged with an explosive substance or provided with some other active payload which has been given a long range.

16 Claims, 2 Drawing Sheets

U.S. PATENT DOCUMENTS

Figure 1:
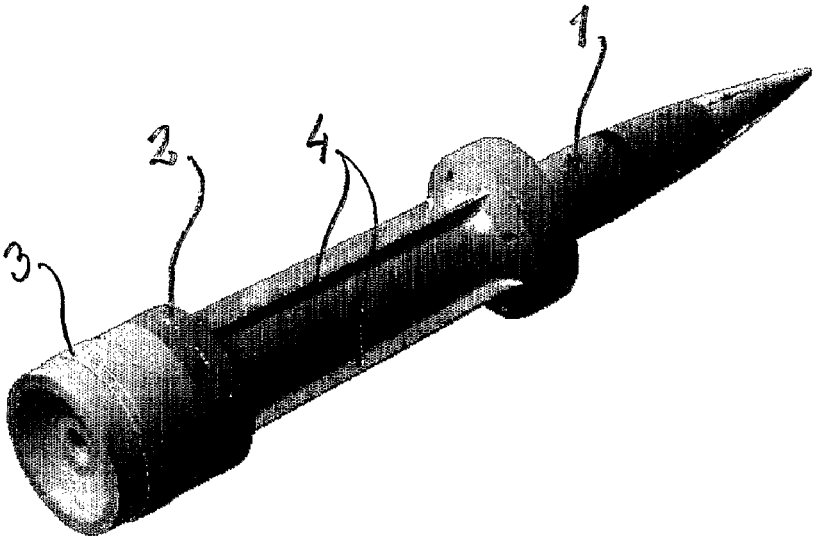

| | | | | |
|---|---|---|---|---|
| 6,886,775 | B2 * | 5/2005 | Johnsson et al. | 244/3.27 |
| 2003/0071166 | A1 | 4/2003 | Moore et al. | |
| 2003/0146342 | A1 * | 8/2003 | Hellman | 244/3.27 |
| 2004/0094661 | A1 | 5/2004 | Johnsson et al. | |
| 2010/0282895 | A1 * | 11/2010 | Geswender | 244/3.29 |

FOREIGN PATENT DOCUMENTS

| | | |
|---|---|---|
| WO | WO-9846962 | 10/1998 |

* cited by examiner

METHOD OF INCREASING THE RANGE OF A SUBCALIBRE SHELL AND SUBCALIBRE SHELLS WITH A LONG RANGE

This application is a national phase of PCT/SE2006/001047, filed on Sep. 14, 2006, which claims priority to SE 0502509-3, filed Nov. 15, 2005, the entire contents of all are hereby incorporated by reference.

TECHNICAL FIELD

The present invention relates to a method for increasing the range of shells charged with an explosive substance or provided with some other active payload.

The invention also relates to a shell charged with an explosive substance or provided with some other active payload which has been given a long range.

PRESENTATION OF THE PROBLEM AND BACKGROUND ART

The method according to the invention for increasing the range of artillery shells charged with an explosive substance and other types of artillery shell which function as carriers of the one or other type of active payload, provides an opportunity for increasing the range of fire of most types of artillery piece by increasing the muzzle velocity and the gliding flight capability of shells fired from them, but without the need to increase the energy content in the propellant charges utilized for firing the projectiles concerned. The novelty proposed in accordance with the invention instead represents a radical modification to the design of the shell utilized in conjunction therewith.

In its more general form, the invention can also be defined as a long-range, subcalibre artillery shell having certain gliding flight characteristics to further increase the range and intended to function as a load carrier for an active payload (for that reason also referred to below as a carrier shell). In a special embodiment, the shell according to the invention can also be guided actively on its trajectory to the target.

Within artillery technology, ever since the first artillery pieces began to appear on the battlefield, the endeavour has in fact been to increase the range of fire of the pieces and to increase their rate of fire and to improve their accuracy.

An attempt has been made in the first instance to achieve increased ranges by increasing the muzzle velocities of the projectiles or shells fired from the pieces with the help of propellant charges having a larger volume or more energy-efficient propellant charges per unit of volume, although in view of the widespread existence of large numbers of slightly older, yet fully serviceable artillery pieces, which would be very expensive to replace, their maximum permissible internal barrel pressure and their maximum charge volumes have often imposed certain restrictions in relation to increasing the ranges of fire simply by an increase in the energy content of the propellant charges. A further possibility of increasing the range of fire primarily of these slightly older artillery pieces has thus been to provide them with new shells or projectiles of improved aerodynamic design. This in turn has resulted in modern artillery shells having been made longer and narrower as a rule than previous types of shell intended for the same artillery pieces.

In the particular instance of tank canons and antitank guns, there has also been a need to impart the highest possible initial velocity to the projectiles fired from them in order to achieve the shortest possible trajectory times to moving targets and the best possible penetration of armour on the target. A previously disclosed method of increasing the muzzle velocity and the projectile velocity of such special armour-piercing projectiles for a long time has been to make the projectiles subcalibre and to fire them with the help of a so-called propulsion mirror. The expression subcalibre is used here to denote that the projectile has a diameter that is smaller than the barrel of the weapon concerned, and the expression propulsion mirror, also referred to as a sabot, is used here to denote the arrangement which encloses the shell or the projectile itself so that the full diameter of the barrel is occupied, which propulsion mirror is discarded once the shell or the projectile has exited from the muzzle of the barrel. This technology was used originally for firing solid metal projectiles of relatively conventional shape, but a change was subsequently made to very slender, finned armour-piercing arrow projectiles that were stabilized, that is to say non-rotating, on their trajectory to the target.

PURPOSE OF THE INVENTION AND ITS DISTINCTIVE FEATURES

One object of the present invention is thus to make available a method for increasing the range of shells charged with an explosive substance or provided with some other active payload, and a shell charged with an explosive substance or provided with some other active payload that has been given a long range, which method and shell eliminate or at least essentially reduce the above-mentioned problems.

The aforementioned object, and other purposes not enumerated here, are achieved in a satisfactory manner within the context of what is indicated in the dependent patent claims.

What has been made available, therefore, according to the present invention, is an improved method of increasing the range of shells charged with an explosive substance or provided with some other active payload, which is characterized in that the shells, on the one hand, are made subcalibre and are provided with folding or fixed rear guide fins, the radial extent or span of which does not exceed the available space between the outside of the respective shell case and the inside of a barrel in an artillery piece utilized for firing the shell and, on the other hand, are provided with fixed or folding front, steerable so-called canard fins, which rear and front fins together provide the shell with certain aerodynamic bearing surfaces primarily during the terminal part of its trajectory, and in that the subcalibre shells are fired from the respective artillery piece with the help of so-called propulsion mirrors adapted for the purpose.

According to further aspects of the method according to the invention, it is true:

- that the range of the shells is further increased by providing the shells with fixed or folding carrier wings extending to either side of the shells in at least one and the same longitudinal section plane arranged in the longitudinal direction of the shells, the radial extent or span of which does not exceed the available space between the outside of the case of the shell and the inside of the barrel in the artillery piece utilized for firing the shells, which carrier wings impart certain gliding flight characteristics to the shells, at least at the end of their trajectory.
- that the stable flight which the carrier wings impart to the shells in question is utilized to give the best possible effect of a stealth configuration of the outsides of the shells in question, comprising a plurality of inclined facetted surfaces which reflect away any incoming radar waves.
- that the gliding flight characteristics of the shells at the end of the trajectory of the shells are improved and the range of the shells is further increased by means of a base flow device or a rocket-booster that is ignited during the optimal part of the trajectory.

The shell charged with an explosive substance or provided with some other active payload, to which a long range has been given, is also characterized in accordance with the invention in that the shell is subcalibre relative to the barrel from which the shell is intended to be fired, and in that the shell is provided with fixed or folding, rear-mounted guide fins, the radial extent or span of which does not exceed the available space between the outside of the case of the shell and the inside of the barrel and also exhibits front, fixed or folding, moving, so-called canard fins.

According to further aspects of the shell charged with an explosive substance or provided with some other active payload, to which a long range has been given, the following is true according to the invention:

that the shell is provided with fixed or folding carrier wings extending to either side of the shell in at least one and the same longitudinal section plane arranged in the shell's own longitudinal direction, the radial extent or span of which does not exceed the available space between the outside of the case of the shell and the inside of the barrel in the artillery piece utilized for firing the shell, which carrier wings impart certain gliding flight characteristics to the shell, at least at the end of the trajectory of the shell.

that the shell comprises a rear-mounted, base flow device or a rocket-booster which, by being ignited at the end of the trajectory of the shell, can improve the gliding flight characteristics of the shell.

that the outer configuration of the shell is embodied in accordance with previously disclosed stealth technology in order, as far as possible, to restrict the opportunities for detecting the flight of the shell with the help of radar.

ADVANTAGES AND EFFECTS OF THE INVENTION

According to the basic principle behind the present invention, subcalibre technology is now also being used in the first place to increase the range of carrier shells charged with an explosive substance and other types of carrier shell. This means that the shell according to the invention will possess a form which resembles that of the above-mentioned fin-stabilized, armour-piercing arrow projectiles, but without being anywhere near as slender as these. According to the invention, in the second place, those parts of the free space available around the subcalibre carrier shell inside the barrel during firing, which space is normally occupied by the propulsion mirror of the shell, are now utilized to a certain extent in addition to provide space for certain aerodynamic bearing surfaces, to further improve the range of the shell, which bearing surfaces increase the gliding fight capability of the shell. These gliding flight surfaces, in their simplest embodiment, can consist of fixed or folding rear fins and front, preferably nose-mounted, fixed or folding, so-called canard fins, which fins can also be executed so that they are movably controllable for the purpose of guiding the shell in accordance with the control commands received by the shell either from a built-in control computer or via terrestrial or GPS control information supplied to the shell via a transmitter-receiver function built into the shell. The expression folding is used here to denote that the aforementioned fins are so arranged as to be capable of being folded in and/or out in relation to the outside of the shell, that is to say including both fins that have been arranged folded against the outside of the shell and fins that have been retracted within the aforementioned outside, as a result of which the extent or the span of the fins in the radial direction outside the outside of the shell is essentially reduced or entirely eliminated during propulsion through the barrel.

The subcalibre carrier shell with its smaller cross section has a slightly smaller load volume per unit of length of the shell, of course, although at the same time it is desirable to give the subcalibre shell a comparatively greater length, for which reason the total load volume does not need to differ too much compared with the full-calibre, more conventional shell. The subcalibre shells in accordance with the present invention can suffer from the disadvantage, however, that their comparatively large length can make them difficult to load automatically, and that it may accordingly be necessary, at least in the case of certain artillery pieces, to load them more or less manually. At the same time, the subcalibre shells in accordance with the invention are intended primarily for use close to the limit of the firing range of current artillery pieces, and they are thus never intended for use as standard shells.

The long-range shell that is characteristic of the invention is thus a subcalibre carrier shell, which can be charged with an explosive substance or can contain some other active payload, and which, like other subcalibre artillery projectiles intended for other purposes, is preferably not rotating on its trajectory, or is only slowly rotating on its trajectory, and the flight of which on its trajectory has been stabilized by means of fixed rear guide fins that are preferably arranged at its own rear end. In a special embodiment of the shell in accordance with the invention, the shell, as already indicated, can also be made guidable at least in the final part of the shell's own trajectory by means of controllable canard fins arranged at the front end of the shell.

In accordance with a further development of the shell according to the invention, the increased range that could be achieved by means of the subcalibration with an associated propulsion mirror and the aerodynamic bearing surfaces of the guide fins and the canard fins, could then in turn be further increased by providing the shell with elongated carrier wings extending in the longitudinal direction of the shell, which offer horizontal bearing surfaces to further improve the gliding flight characteristics of the shell. The carrier wings in this particular case are thus envisaged to extend in pairs to either side of the shell in the longitudinal direction of the shell within one and the same longitudinal plane, that is to say comprising at least one longitudinal plane having two, four, six, etc., carrier wings arranged with at least two carrier wings in the same longitudinal plane. The carrier wings are also intended to be fixed, by preference, although this means that their span is restricted by the available space between the outside of the case of the subcalibre shell and the inside of the barrel. This problem is reduced significantly, however, if the carrier wings are instead so arranged as to be capable of being folded in and folded out.

In accordance with yet another variant of the invention, the range already increased by means of the carrier wings can be further increased by providing the shell with a base flow device or a rocket-booster that is activated in the optimal part of the trajectory of the shell. The air resistance is reduced effectively by the addition of a base flow to the shell by causing an explosive charge to burn and to equal out the negative pressure that is produced behind the shell.

A shell designed in accordance with the variants of the invention described above must never rotate on its trajectory, therefore, and it must be loaded and fired from the artillery piece utilized to fire it in such a way that the bearing surfaces of the fins and any carrier wings are horizontal, at least in the final part of the trajectory, so that the gliding flight characteristics of the shell can be utilised to their full extent.

In order for the shell provided with carrier wings in accordance with this variant of the invention to be capable of being used in the intended way, that is to say with a terminal gliding and/or powered flight more resembling that of an aircraft, the shell must be rotationally stable on its trajectory, that is to say the shell must lie with the bearing surfaces of the carrier wings oriented horizontally. This requirement for a stable, aircraft-like flight for the shell in accordance with the invention now offers the opportunity to utilize the stealth technology previously disclosed in its own right in artillery shells for the first time and, in accordance therewith, to manufacture shells that are impossible or at least very difficult to detect by means of conventional radar. A stealth shell of this kind embodied in accordance with this development of the invention will accordingly, in addition to its elongated form and its elongated carrier wings in their own right with their short span restricted by the interior of the bore of the barrel, and their preferably fixed rear guide fins and any canard fins intended for guiding the final phase of the shell, also be characterized in that the actual case of the shell, instead of exhibiting a circular cross section in the conventional manner and associated continuous, bulging lateral surfaces, will now exhibit a plurality of inclined, lateral part surfaces or facetted surfaces from which 90-degree reflector surfaces are totally absent, and all of which have been designed with the intention that they will reflect away all incoming radar waves to the shell in an entirely different direction to the direction from which the radar waves were originally aimed at the shell. The fact that the enemy is able to use radar in order rapidly to locate a firing artillery piece with reference to the trajectories of the shells fired from it, and then to bring counterfire to bear rapidly against the firing piece, has constituted absolutely the greatest threat to artillery in the past, and the availability of effective stealth shells to the artillery should be regarded as a major, but double-edged advance.

Further advantages and effects will be appreciated from the study and consideration of the following, detailed description of the invention, including a number of its advantageous embodiments, together with the patent claims and the figures in the accompanying drawings.

LIST OF FIGURES

The invention is described below in more detail with reference to the accompanying FIGS. 1-4, all of which depict various schematic variants of artillery shells in accordance with the invention as a projection from an angle.

DETAILED DESIGN DESCRIPTION

FIG. 1 thus depicts a subcalibre artillery shell 1 provided with its associated propulsion mirror 2, that is to say in the state in which the shell 1 is ready to be loaded into the artillery piece from which it is intended to be fired. As can be appreciated from the figure, the propulsion mirror 2 is provided with a sliding belt 3 with the task of guaranteeing the non-rotating firing of the shell 1 and the propulsion mirror 2 from a rifled barrel. It can also be appreciated form the figure that the propulsion mirror 2 is provided with reinforcing flanges 4, within which the carrier wings 11, 12 and 14, 15 depicted in FIG. 3 and FIG. 4 could also be protected during the actual firing.

Figure 2:
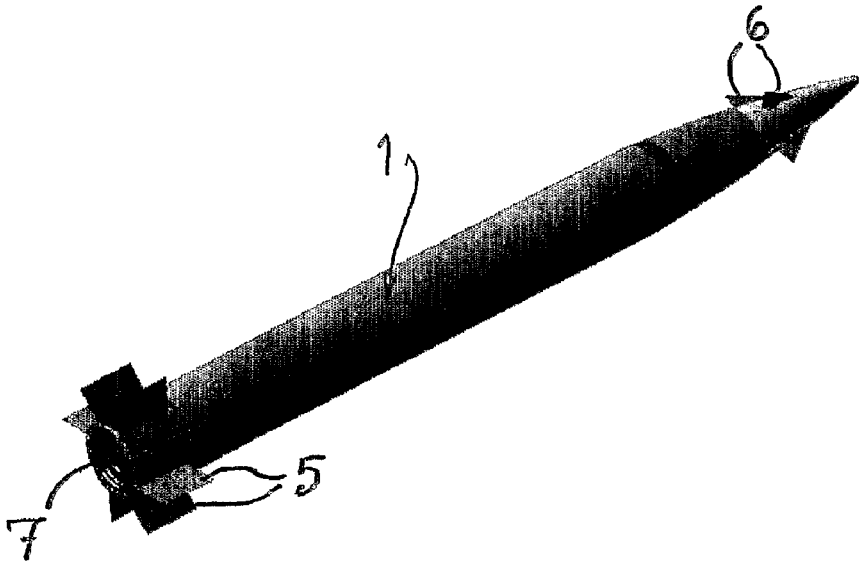

FIG. 2 depicts the shell 1 after the shell 1 has left the barrel from which the shell 1 has been fired and has been released from the propulsion mirror 2, which propulsion mirror 2 is divided and is thus discarded from the shell 1 as soon as it has exited from the barrel. Fixed fins 5 preferably arranged at the rear of the shell 1 are exposed as the propulsion mirror 2 parts from the shell 1. The guide fins 5 can also be so arranged as to be capable of being unfolded out of or raised from the outside of the shell 1. Front, nose-mounted canard guide wings 6 will also have been unfolded from the nose cone of the shell 1. These controllable, moving canard fins 6 are utilized primarily for guiding the shell 1 on its trajectory towards its intended target, although they also contribute to the aerodynamic bearing surfaces of the shell 1. The canard fins 6 could also have been non-retractable, that is to say fixed, provided that their span is not greater than the space available inside the barrel. Also shown at the rear end of the shell 1 is an outlet for a base flow device 7. The range of the shell 1 could be further increased with the help of the aforementioned base flow device 7 or a rocket-booster.

Figure 3:
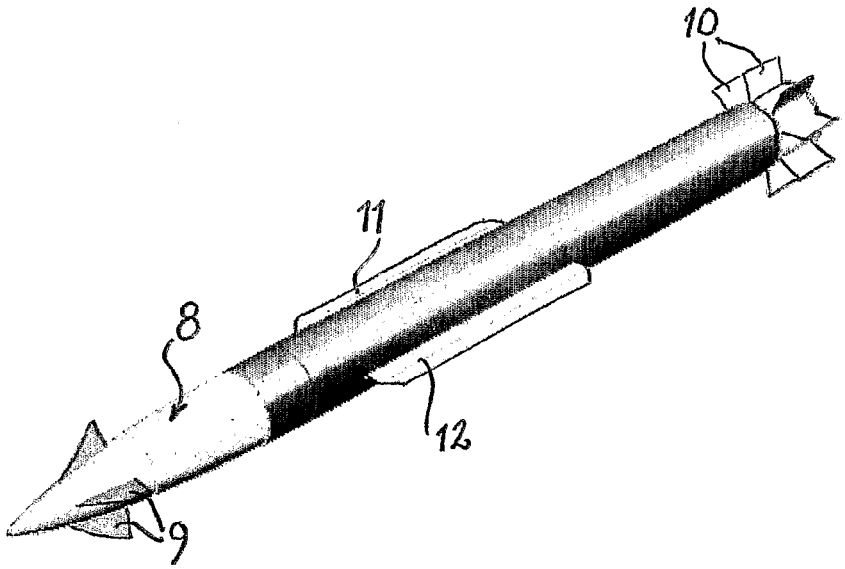

FIG. 3 in turn depicts a second variant of the above shell, here designated as 8. In addition to front canard fins 9 and rear guide fins 10, the shell 8 is also provided with two elongated carrier wings 11 and 12. The carrier wings 11 and 12 are arranged to either side of the shell 8 in one and the same division plane. Precisely like the span of the rear guide fins 10, the span of the carrier wings 11, 12 is sufficiently small for them to be accommodated inside the barrel of the firing artillery piece during firing. In the case of folding carrier wings, these are arranged inside or are folded against the outside of the shell 8 so that the radial extent of the carrier wings is sufficiently small for the carrier wings to be accommodated in the barrel as already described above.

Figure 4:
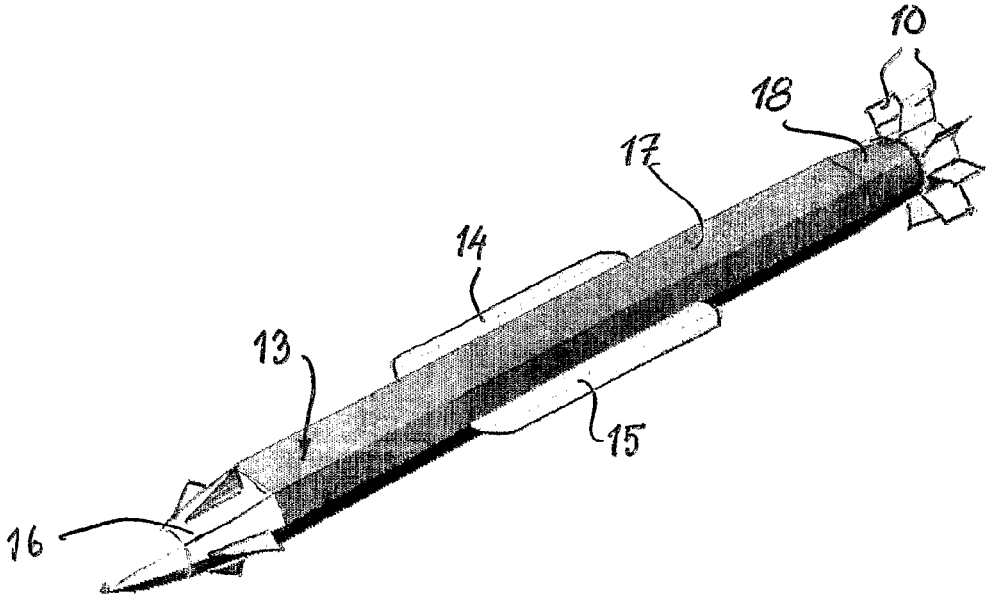

FIG. 4 finally depicts a shell 13 provided with carrier wings having essentially the same basic construction as the shell 8 depicted in FIG. 3, although use has been made in this case of the non-rotating flight of the shell 13, for which its carrier wings designated here as 14 and 15 are a guarantee, together with a subdivision of the outer sides of the shell 13 into a number of stealth technology-based, inclined flank sides or facetted surfaces 16-18, which reflect away all incoming radar waves to the shell 13 in an inclined direction, in order to give a shell 13 which entirely lacks 90-degree corner reflectors and in addition can be provided with or painted with a radar-absorbent surface or paint, which, when taken together, means that the trajectory of the shell 13 is to all intents and purposes impossible to detect by means of conventional radar technology.

In embodiments not depicted here, it is conceivable that a further one or more pairs of carrier wings is/are arranged in pairs, at the front or at the rear, oriented in the same longitudinal plane as the first pair of carrier wings or in a further one or more parallel longitudinal planes, although in this case separated in a radial direction, away from the first longitudinal plane, or are arranged in a plurality of mutually intersecting longitudinal planes.

The designation shell and barrel artillery piece are used here to denote primarily shells and barrel artillery pieces that are suitable for attacking targets at considerable distances, where the shell has an essentially high trajectory, for example an artillery shell and an artillery piece, although this does not exclude shells, projectiles and barrel artillery pieces that are suitable for a more shallow or shorter trajectory, for example antitank guns, tank canons, trench mortars, etc., with their associated shells.

The invention claimed is:

1. A method for increasing the range of shells charged with an explosive substance or provided with some other active payload, wherein the shells are subcalibre and comprise fixed rear guide fins, the radial extent or span of the fixed rear guide fins does not exceed the available space between the outside of the respective shell case and the inside of a barrel in an artillery piece utilized for firing the shell and further comprising fixed front steerable canard fins, and wherein the rear and front fins together provide the shell with certain aerodynamic bearing surfaces primarily during the terminal part of its trajectory, and wherein the method comprises firing the subcalibre shells from the respective artillery piece with the help of propulsion mirrors adapted for the purpose of the firing.

2. The method according to claim 1, wherein the range of the shells is further increased by providing the shells with fixed or folding carrier wings extending to either side of the shells in at least one and the same longitudinal section plane arranged in the longitudinal direction of the shells, the radial extent or span of which does not exceed the available space between the outside of the case of the shell and the inside of the barrel in the artillery piece utilized for firing the shells, and wherein the carrier wings impart certain gliding flight characteristics to the shells, at least at the end of their trajectory.

3. The method according to claim 2, wherein the stable flight which the carrier wings impart to the shells is utilized to give the best possible effect of a stealth configuration of the outsides of the shells, comprising a plurality of inclined facetted surfaces which reflect away any incoming radar waves.

4. The method according to claim 1, wherein the gliding flight characteristics of the shells at the end of the trajectory of the shells are improved and the range of the shells is further increased by means of a base flow device or a rocket-booster that is ignited during the optimal part of the trajectory.

5. A shell charged with an explosive substance or provided with some other active payload, to which a long range has been imparted in accordance with the method according to claim 1, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

6. The shell charged with an explosive substance or provided with some other active payload, to which a long range has been imparted according to claim 5, wherein the shell further comprises fixed or folding carrier wings extending to either side of the shell in at least one and the same longitudinal section plane arranged in the longitudinal direction of the shell, the radial extent or span of the carrier wings does not exceed the available space between the outside of the case of the shell and the inside of the barrel in the artillery piece utilized for firing the shell, and wherein the carrier wings impart certain gliding flight characteristics to the shell, at least at the end of the trajectory of the shell.

7. The shell charged with an explosive substance or provided with some other active payload according to claim 5, wherein the shell comprises a rear-mounted, base flow device or a rocket-booster which, by being ignited at the end of the trajectory of the shell, can improve the gliding flight characteristics of the shell.

8. The shell charged with an explosive substance or provided with some other active payload according to claim 5, wherein the outer configuration of the shell is embodied in accordance with previously disclosed stealth technology in order, as far as possible, to restrict the opportunities for detecting the flight of the shell with the help of radar.

9. The method according to claim 2, wherein the gliding flight characteristics of the shells at the end of the trajectory of the shells are improved and the range of the shells is further increased by means of a base flow device or a rocket-booster that is ignited during the optimal part of the trajectory.

10. The method according to claim 3, wherein the gliding flight characteristics of the shells at the end of the trajectory of the shells are improved and the range of the shells is further increased by means of a base flow device or a rocket-booster that is ignited during the optimal part of the trajectory.

11. A shell charged with an explosive substance or provided with some other active payload, to which a long range has been imparted in accordance with the method according to claim 2, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

12. A shell charged with an explosive substance or provided with some other active payload, to which a long range has been imparted in accordance with the method according to claim 3, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

13. A shell charged with an explosive substance or provided with some other active payload, to which a long range has been imparted in accordance with the method according to claim 4, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

14. A shell charged with an explosive substance or provided with some other active payload according to claim 6, wherein the shell comprises a rear-mounted, base flow device or a rocket-booster which, by being ignited at the end of the trajectory of the shell, can improve the gliding flight characteristics of the shell.

15. A shell charged with an explosive substance or provided with some other active payload, to which a long range has been imparted in accordance with the method according to claim 9, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

16. A shell charged with an explosive substance or provided with some other active payload, to which a long range has been imparted in accordance with the method according to claim 10, wherein the shell is subcalibre relative to the barrel from which the shell is intended to be fired, comprises fixed rear-mounted guide fins, the radial extent or span of the fixed rear guide fins does not exceed the available space between the outside of the case of the shell and the inside of the barrel and further comprising front fixed moving canard fins.

* * * * *